US006319039B1

(12) United States Patent
Chambly

(10) Patent No.: US 6,319,039 B1
(45) Date of Patent: Nov. 20, 2001

(54) CONNECTOR FOR CONNECTING ELECTRICAL CONDUCTORS SO THAT THE CONDUCTORS ARE MAINTAINED AND PROTECTED IN WATERTIGHT CONTACT

(75) Inventor: Lawrence R. Chambly, Winnsboro, TX (US)

(73) Assignee: U.S.A. Harness, Inc., Winnsboro, TX (US)

( * ) Notice: Subject to any disclaimer, the term of this patent is extended or adjusted under 35 U.S.C. 154(b) by 0 days.

(21) Appl. No.: 09/491,179

(22) Filed: Jan. 25, 2000

(51) Int. Cl.[7] ..... H01R 4/50; H01R 13/625

(52) U.S. Cl. ..... 439/347; 439/282

(58) Field of Search ..... 439/347, 282, 439/359

(56) References Cited

U.S. PATENT DOCUMENTS

| | | | | |
|---|---|---|---|---|
| 2,499,825 | | 3/1950 | Havlicek | 173/328 |
| 3,124,405 | | 3/1964 | Massa . | |
| 3,611,255 | | 10/1971 | Shroyer . | |
| 3,713,076 | | 1/1973 | Gabrielian et al. . | |
| 3,760,332 | * | 9/1973 | Berkovits et al. | 439/347 |
| 3,915,476 | | 10/1975 | Burkle | 280/422 |
| 4,017,139 | | 4/1977 | Nelson . | |
| 4,148,538 | * | 4/1979 | Rodondi | 439/347 |
| 4,366,965 | | 1/1983 | Rhodes | 280/421 |
| 4,746,306 | | 5/1988 | Yurtin et al. | 439/357 |
| 4,842,524 | | 6/1989 | Hopkins et al. | 439/35 |
| 4,938,710 | | 7/1990 | Aihara et al. | 439/345 |
| 5,178,547 | | 1/1993 | Bonas et al. | 439/34 |
| 5,248,259 | | 9/1993 | Naito et al. | 439/34 |
| 5,462,448 | | 10/1995 | Kida et al. | 439/357 |

FOREIGN PATENT DOCUMENTS 1-294383 * 11/1989 (JP) .

* cited by examiner

*Primary Examiner*—Brian Sircus
*Assistant Examiner*—Javaid Nasri
(74) *Attorney, Agent, or Firm*—F. Lindsey Scott

(57) ABSTRACT

A connector for connecting electrical conductors and including first and second conductor-containing bodies configured to sealingly connect the conductors when the first and second body are matingly joined. A passageway is formed to accept a pin when the first and second body are matingly joined so that the pin, which is a different color than the first and second body, is readily observable in position to confirm that the first and retains the first and second body in mating engagement and so that the pin, which is a different second body are matingly joined.

18 Claims, 3 Drawing Sheets

CONNECTOR FOR CONNECTING ELECTRICAL CONDUCTORS SO THAT THE CONDUCTORS ARE MAINTAINED AND PROTECTED IN WATERTIGHT CONTACT

BACKGROUND OF THE INVENTION

1. Field of the Invention

This invention comprises a connector for connecting electrical conductors so that the conductors are maintained in protected and verifiable contact 2. Brief Description of the Prior Art Many connector designs have been proposed for use in connecting electrical conductors. Many of these connectors are very effective in the applications for which they are designed. Unfortunately, a connector designed for connecting an electrical conductor to a household outlet is not likely to be effective when used as a connector for heavy equipment, such as, over-the-road semi-trailer trucks and the like. Connectors for such applications must be watertight and must be resistant to separation under conditions of vibration and the like. Further, such connectors must be rugged to withstand abrasion and other detrimental contacts during use.

Accordingly, many attempts have been made to develop connectors for electrical conductors, which are effective and suitable for such applications. Notwithstanding the availability of a variety of connectors, a need remains for an electrical conductor connector, which can ensure reliable and easily verifiable waterproof contact in such applications.

SUMMARY OF THE INVENTION

According to the present invention, a connector for connecting electrical conductors is provided and comprises: a first conductor-containing body formed of a resilient material and having a receptacle opening having an inside and a sidewall, a first seal-enhancing fitting positioned around the inside of the receptacle opening and at least one first electrical conductor connector fitting configured to engage at least one mating electrical conductor connector fitting; a second conductor-containing body formed of a resilient material and having an extended portion formed to matingly engage the receptacle opening and having an outside and a second seal-enhancing fitting positioned around the outside of the extended portion and at least one second electrical conductor connector fitting configured to matingly engage the at least one first electrical conductor connector fitting; an alignment opening comprising a first opening through the sidewall of the receptacle opening and a second opening in the extended portion so that the first opening and the second opening are in alignment when the extended portion is positioned in the receptacle opening with at least one first electrical conductor connector fitting in full engagement with at least one second electrical conductor connector fitting; and a pin configured to fit in the alignment opening when the first opening and the second opening are in alignment.

DESCRIPTION OF THE PREFERRED EMBODIMENTS

In the description of the FIGS., the same or similar numbers will be used throughout to refer to the same or similar components.

Figure 1:
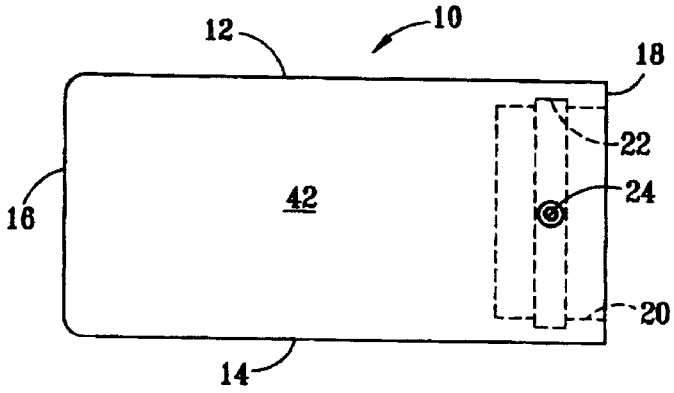
FIG. 1 is a side view of a first conductor-containing body having a receptacle opening.

In FIG. 1 a side view of a first conductor-containing body 10 is shown. Body 10 includes a first side 12, a second side 14 and a side 42. Body 10 also includes a first end 16 and a second end 18. Body 10 includes a receptacle opening 20, which includes a first seal-enhancing fitting, shown as a groove 22 positioned generally around an inside of receptacle opening 20. Receptacle opening 20 can be round, elliptical, square and the like. Desirably the first seal-enhancing fitting, shown as groove 22, extends around the inside perimeter of receptacle 20. Body 10 also includes a passageway 24 through a sidewall of receptacle opening 20. Receptacle 20 is open at end 18 and is sized to matingly engage an extended portion on a second conductor-containing body.

Insulated electrical conductors (not shown) are typically joined to body 10 at its end 16 or optionally at one of its sides. These conductors are generally sealingly covered by suitable insulating material as well known to those skilled in the art and are sealingly joined to body 10. The insulating material may be reinforced with suitable materials as known to those skilled in the art to provide abrasion-resistant conductors. Similarly the conductors may be joined to body 10 as a plurality of single insulated conductors or as a plurality of conductors carried in a single insulated cable or the like. Such variations are considered to be known to those skilled in the art and the conductors joined to either of the conductor-containing bodies used for connection of the conductors in the present invention will not be discussed further.

Figure 2:
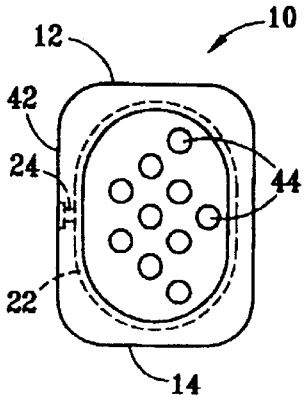
FIG. 2 is an end view of the receptacle-containing end of the body shown in FIG. 1.

In FIG. 2 an end view of body 10, taken at end 18, is shown. Body 10 includes ten electrical conductor connector fittings 44 configured to engage mating electrical conductor connector fittings in a second conductor-containing body 26. Connector fittings 44 may be of any suitable configuration known to those skilled in the art for matingly joining electrical conductors. For instance, receptacle and socket connectors or other types of connectors commonly used in the art for this purpose may be used. Desirably, first conductor-containing body 10 and second conductor-containing body 26 are formed of a suitably resilient material so that groove 22 can be positioned over a second seal-enhancing fitting, such as a ring on a second conductor body to position the ring in groove 22.

Figure 3:
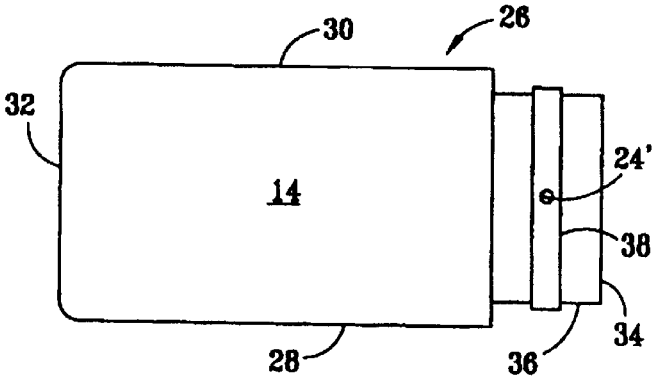
FIG. 3 is a side view of a second conductor-containing body having an extended portion configured to matingly engage the receptacle opening on the conductor body shown in FIG. 1.

Second conductor-containing body 26 adapted for mating engagement with conductor body 10 is shown in FIG. 3. Second conductor body 26 includes a first side 28, a second side 30, a first end 32 and a second end 34. Second body 26 also includes an extended portion 36 which includes second seal-enhancing fitting, shown as a ring 38, positioned around the outside of extended portion 36. Ring 38 is shaped to matingly engage groove 22 when first body 10 and second body 26 are in mating engagement. A passageway 24' extends into extended portion 36 in ring 38. Passageway 24' desirably extends a suitable distance into extended portion 36 so that a pin 48 (shown in FIG. 5) can be extended through passageway 24 and into passageway 24' when first body 10 and second body 26 are in mating engagement.

Figure 4:
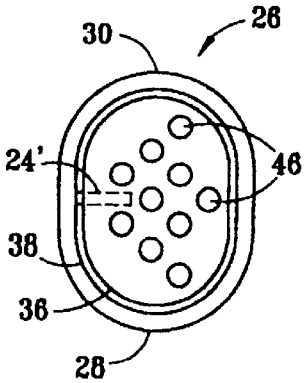
FIG. 4 is an end view of the extended portion end of the body shown in FIG. 3.

In FIG. 4 an end view of extended portion 36 is shown. Extended portion 36 includes conductor connectors 46, which are configured to matingly engage conductor connectors 44 in body 10. Passageway 24' is shown extending into extended portion 36 in an area such that it does not come in to engagement with any of the conductor connectors.

Figure 5:
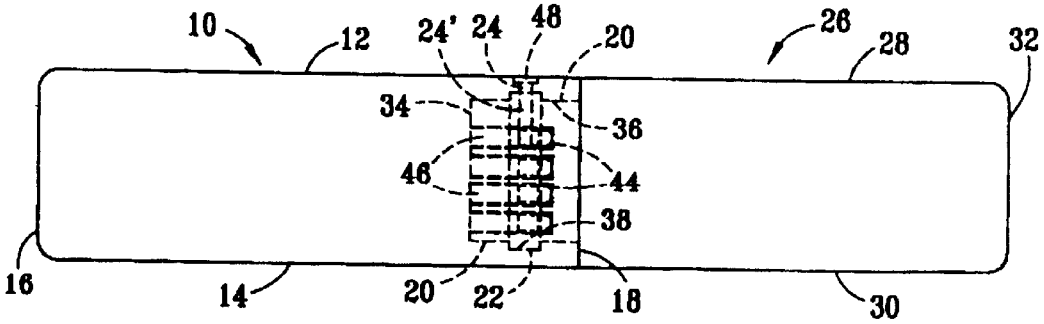
FIG. 5 shows the conductor body of FIG. 1 and FIG. 2 matingly joined to the second body shown in FIG. 3 and FIG. 4.

When first body 10 and second body 26 are placed in mating engagement, as shown in FIG. 5, passageways 24 and 24' are in alignment Pin 48 is then placed in passageways 24 and 24' to ensure that body 10 and body 26 are in proper engagement. Desirably pin 48 is fabricated of a non-conductive material and is a contrasting color with respect to at least one of the first and second body. Desirably body 10 and body 26 are fabricated of a suitably resilient, durable material so that they can be pushed into mating engagement so that the engagement is suitably tight to provide watertight connection between fittings 44 and 46. Pin 48 is then positioned in passageways 24 and 24' to ensure that first body 10 and second body 26 are and remain in mating engagement. Desirably pin 48 is of a different color than body 10 so that it is readily observed in position securing body 10 and body 26 in mating engagement. The resulting electrical connector provides dependable and verifiable electrical connection of conductors 44 and 46.

Figure 6:
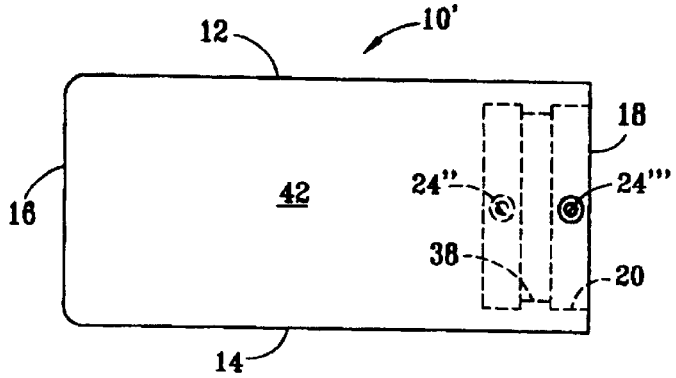
FIGS. 6, 7, 8, 9 and 10 show a second embodiment of a similar first conductor-containing body and a second conductor-containing body formed for mating engagement as shown in FIG. 10.
Figure 7:
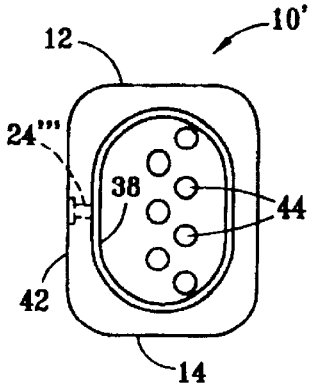
Figure 8:
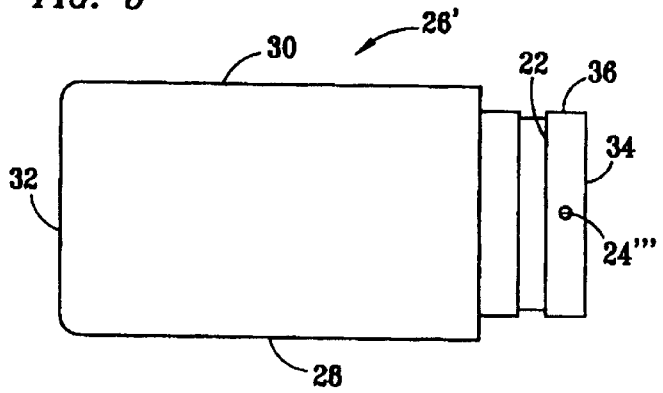
Figure 9:
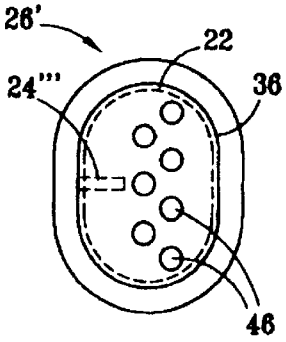
Figure 10:
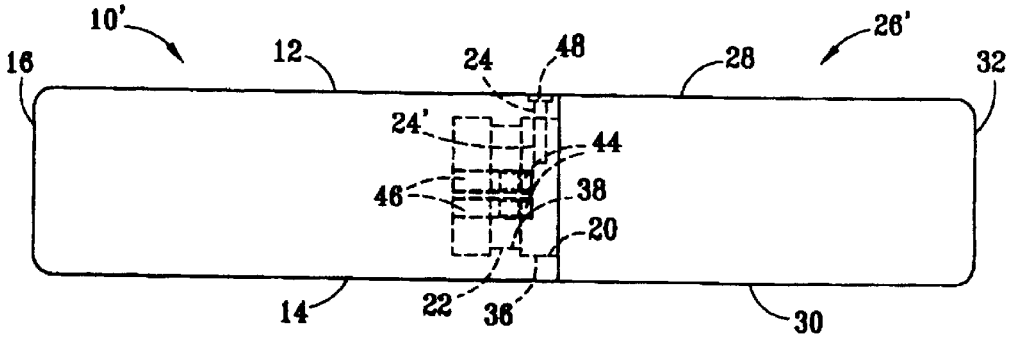

FIGS. 6–10 show an alternate embodiment of a connector including a first conductor-containing body 10' and a second conductor-containing body 26', as shown in FIG. 1–5. The connector shown in FIGS. 6–10 shows alternate positions for passageway 24 as passageways 24" and 24'". These alternate positions are shown in FIG. 6. Further it will be noted in FIGS. 6–10 that instead of a groove 22 in receptacle 20, as shown in FIG. 1, first body 10' and second body 26' are configured so that the receptacle opening includes a ring rather than a groove with the groove being positioned on the extended portion. Either arrangement is acceptable so long as the ring and groove are in mating and sealing engagement when the first and second bodies are engaged. In the embodiment shown in FIGS. 6–10, seven conductor connector fittings 44 and 46 are shown in receptacle opening 20 and in extended portion 36. First bodies 10' and 26' are shown in mating engagement in FIG. 10.

Desirably pin 48 is positioned to extend through a sidewall of the receptacle opening and into the extended portion in the area of the groove and ring. It is not necessary that the pin be positioned through the groove and ring. As shown in FIG. 6, it can be positioned in other locations. The passageway 24' extending into the extended portion is positioned to be in alignment when the conductor-containing bodies are in mating engagement and so that the pin will not engage any conductor and will not extend through extended portion 36, especially when multiple conductors are used. Although not preferred, the passage-way may be extended to extend pin 48 through the conductor-containing bodies if desired.

Figure 11:
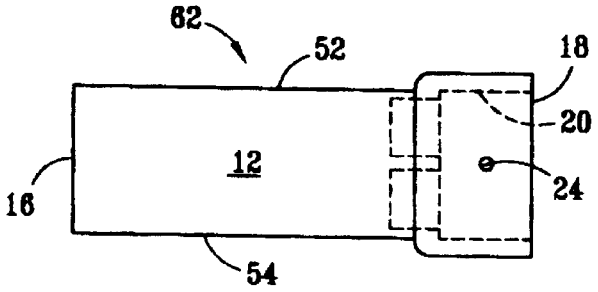
FIG. 11 shows a first conductor-containing body containing two conductors.
Figure 12:
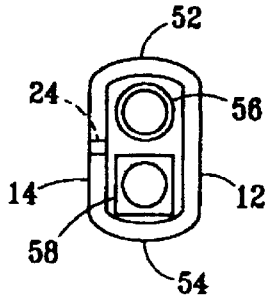
FIG. 12 shows an end view of the conductor-containing body shown in FIG. 11.

In FIGS. 11 and 12 a first body 62 is shown having a receptacle opening 20 and having a top 52 and a bottom 54 and a first side 12. Body 62 has a first end 16 and a second end 18 with a receptacle opening at end 18. Body 62 includes two electrical conductor connectors.

In FIG. 12 an end view of first body 62 in FIG. 11 is shown. It will be noted that the two conductor connector fittings 56 and 58 respectively are of different shapes. Suitable mating fittings are positioned in a second body (not shown) having an extended portion thereon for mating engagement with first body 62. A ring and groove engagement (not shown) is desirably positioned so that a ring and groove are engaged between an extended portion on the second body (not shown) and the inside of receptacle opening 20. The use of different shaped connectors in FIG. 12 is desirable to ensure proper connection. With more than two connectors, the arrangement of the connectors can be used to ensure proper connection.

Figure 13:
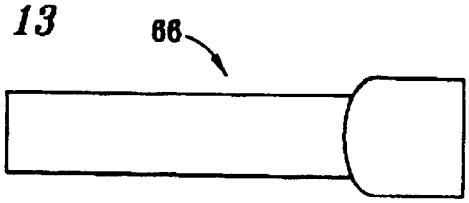
FIG. 13 shows a connector body adapted to connect with a second connector body to connect a single conductor.

In FIG. 13 a first body 66 is shown which is adapted to include a single conductor connector fitting.

Figure 14:
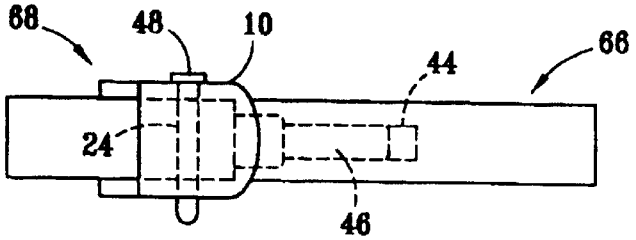
FIG. 14 shows a first and a second connector body in mating engagement to connect a single conductor.

FIG. 14 schematically shows first body 66 engaged with a second body 68 which includes a conductor connecting fitting 46 which is engaged with a conductor connector fitting 44 in first body 66. In such instances a groove and ring arrangement (not shown) are desirably used and it will be noted that pin 48 extends completely through the sidewall of first body 66 and the extended portion of second body 68. Pin 48, as shown, prevents rotation of first body 66 and second body 68 relative to each other.

Figure 15:
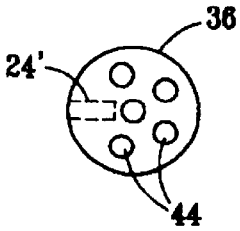
FIG. 15 shows a conductor configuration containing five conductors in an extended portion of a connector body.
Figure 16:
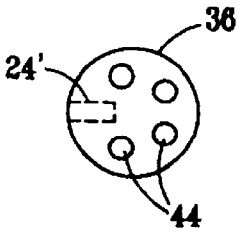
FIG. 16 is a end view of an extended portion of a connector body containing four conductors; and, FIG. 17 is an end view of an extended portion of a connector body containing six conductors.
Figure 17:
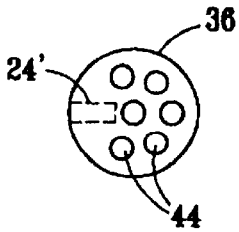

In FIGS. 15–17, arrangements of conductor connectors are shown in end portions showing suitable arrangements for four, five and six connectors.

As noted, the conductors extending away from the electrical conductor connector bodies of the present invention have not been shown for simplicity.

In the embodiments discussed, it is desirable that the bodies containing the conductors be formed of a suitable hard, resilient rubber or plastic or like material so that when the first and second bodies are joined a sealing connection is achieved between the ring and groove and desirably between the ends of the first and second body and desirably between the inside of the receptacle opening and the outside of the extended portion. In any event, the passageways are positioned so that when the first and second bodies are fully engaged the passageways 24 and 24' are in full alignment and pin 48 can readily be positioned to retain first and second bodies in complete engagement. When pin 48 is a different color, it can serve as a visual indication that the first and second bodies are in complete mating contact. In the event it should be desired to disassemble the first and second body for any reason, the pin can be removed and the bodies can be pulled apart by the application of sufficient force to slide the ring from the groove and to remove the extended portion from engagement with the receptacle opening.

Either male or female connector fittings may be positioned in either of the conductor-containing bodies so long as mating connector fittings are positioned in the other of the conductor-containing bodies.

Desirably the pin does not extend all the way through the connector except in embodiments using one or two connectors. Such variations are shown in FIG. 14. Such fittings are useful in many applications but find particular applicability to the electrical harness used in semi-trailer trucks and other over-the-road vehicles. Such connectors are subjected to almost continual vibration and are exposed to water, salt water, abrasive materials and the like. It is vital that such connectors remain in effective electrical connection to ensure safe operation of the vehicles. It is important that the integrity of the connection can be easily checked. By the use of the colored pin of the present invention, the integrity of the connection can be checked visually at a substantial distance thereby ensuring that the connections will be checked frequently and that their integrity can be verified immediately.

Having described the present invention by reference to certain of its preferred embodiments, it is respectfully submitted that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

Having thus described the invention, I claim:

1. A connector for connecting a first cable electrical conductor and a second cable electrical conductor consisting essentially of:

a) a first conductor-containing body formed of a resilient material and having a receptacle opening having an inside and a sidewall, a first seal-enhancing fitting positioned around the inside of the receptacle opening and at least one first electrical conductor connector fitting configured to matingly engage a second electrical conductor connector fitting the first electrical conductor connector being in electrical contact with the first cable electrical conductor;

b) a second conductor-containing body formed of a resilient material and having an extended portion, formed to matingly engage the receptacle opening and having an outside and a second seal-enhancing fitting positioned around the outside of the extended portion the first seal-enhancing fitting and the second seal-enhancing fitting being configured for watertight sealing engagement when the first conductor-containing body and the second conductor-containing body are placed in mating engagement and said second electrical conductor connector fitting is configured to matingly engage at least said first electrical conductor connector fitting the second electrical conductor connector being in electrical contact with the second cable electrical conductor;

c) an alignment openings comprising a first opening through the sidewall of the receptacle opening and a second opening in the extended portion so that the first opening and the second opening are in alignment when the extended portion is positioned in watertight mating engagement with the receptacle opening with at least said one first electrical conductor connector fitting in mating engagement with at least said second electrical conductor connector fitting; and, d) a removable pin configured to fit in the alignment opening when the first opening and the second opening are in alignment to retain the extended portion in mating engagement with the receptacle opening.

2. The connector of claim 1 wherein the pin is of a contrasting color with respect to the first body to enable observation that the pin is in position securing the first and second body in mating engagement.

3. The connector of claim 2 wherein the resilient material is selected from the group consisting of resilient plastics and rubber.

4. The connector of claim 1 wherein the first seal-enhancing fitting is a recessed area around the inside of the receptacle opening and the second seal-enhancing fitting is a raised area configured to sealingly engage the recessed area and positioned around the outside of the extended portion.

5. The connector of claim 4 wherein the raised area is a ring.

6. The connector of claim 5 wherein the raised area is a ring.

7. The connector of claim 5 wherein the recessed area is a groove.

8. The connector of claim 4 wherein the recessed area is a groove.

9. The connector of claim 1 wherein the first seal-enhancing fitting is a raised area inside of the receptacle opening and the second seal-enhancing fitting is a recessed area configured to sealingly engage the raised area and positioned around the outside of the extended portion.

10. The connector of claim 1 wherein the first electrical conductor connector fitting is a male fitting and wherein the second electrical conductor connector fitting is a female fitting.

11. The connector of claim 1 wherein one or two first electrical conductor connector fittings are used, wherein one or two second electrical conductor connector fittings are used, wherein the alignment opening extends through the sidewall of the receptacle opening at two points and through the extended portion and wherein the pin extends through the connector.

12. The connector of claim 1 wherein the first electrical conductor connector fitting is a female fitting and wherein the second electrical conductor connector fitting is a male fitting.

13. The connector of claim 1 wherein the first body and the second body are sealingly joined when the extended portion is positioned in the receptacle opening.

14. The connector of claim 1 wherein the receptacle opening contains a plurality of first electrical conductor connector fittings.

15. The connector of claim 1 wherein the receptacle opening contains a plurality of second electrical conductor connector fittings.

16. The connector of claim 1 wherein the first body and the second body may be disengaged after removal of the pin.

17. A connector for connecting electrical conductors consisting essentially of:

a) a first conductor-containing body formed of a resilient material and having a receptacle opening having an inside and a sidewall, a first seal-enhancing fitting positioned around the inside of the receptacle opening and at least one first electrical conductor connector fitting configured to matingly engage a second electrical conductor connector fitting;

b) a second conductor-containing body formed of a resilient material and having an extended portion formed to matingly engage the receptacle opening and having an outside and a second seal-enhancing fitting positioned around the outside of the extended portion the first seal-enhancing fitting and the second seal-enhancing fitting being configured for watertight sealing engagement when the first conductor-containing body and the second conductor-containing body are placed in mating engagement, said second electrical conductor connector fitting being configured to matingly engage at least said first electrical conductor connector fitting; wherein the first seal-enhancing fitting is a raised area inside of the receptacle opening and the second seal-enhancing fitting is a recessed area configured to sealingly engage the raised area and positioned around the outside of the extended portion; and, wherein the alignment opening is positioned to extend through the raised area and the recessed area;

c) an alignment opening comprising a first opening through the sidewall of the receptacle opening and a second opening in the extended portion so that the first opening and the second opening are in alignment when the extended portion is positioned in watertight mating engagement with the receptacle opening with at least said one first electrical conductor connector fitting in mating engagement with at least said second electrical conductor connector fitting; and, d) a removable pin configured to fit in the alignment opening when the first opening and the second opening are in alignment to retain the extended portion in mating engagement with the receptacle opening.

18. A connector for connecting electrical conductors consisting essentially of:

a) a first conductor-containing body formed of a resilient material and having a receptacle opening having an inside and a sidewall, a first seal-enhancing fitting positioned around the inside of the receptacle opening and at least one first electrical conductor connector fitting configured to matingly engage a second electrical conductor connector fitting;

b) a second conductor-containing body formed of a resilient material and having an extended portion formed to matingly engage the receptacle opening and having an outside and a second seal-enhancing fitting positioned around the outside of the extended portion the first seal-enhancing fitting and the second seal-enhancing fitting being configured for watertight sealing engagement when the first conductor-containing body and the second conductor-containing body are placed in mating engagement, said second electrical conductor connector fitting being configured to matingly engage at least said first electrical conductor connector fitting wherein the first seal-enhancing fitting is a recessed area around the inside of the receptacle opening and the second seal-enhancing fitting is a raised area configured to sealingly engage the recessed area and positioned around the outside of the extended portion and wherein the alignment opening is positioned to extend through the recessed area and the raised area;

c) an alignment opening comprising a first opening through the sidewall of the receptacle opening and a second opening in the extended portion so that the first opening and the second opening are in alignment when the extended portion is positioned in watertight mating engagement with the receptacle opening with at least said one first electrical conductor connector fitting in mating engagement with at least said second electrical conductor connector fitting; and, d) a removable pin configured to fit in the alignment opening when the first opening and the second opening are in alignment to retain the extended portion in mating engagement with the receptacle opening.

* * * * *